US008265940B2

(12) United States Patent
Geiser et al.

(10) Patent No.: US 8,265,940 B2
(45) Date of Patent: Sep. 11, 2012

(54) METHOD AND DEVICE FOR THE ARTIFICIAL EXTENSION OF THE BANDWIDTH OF SPEECH SIGNALS

(75) Inventors: Bernd Geiser, Aachen (DE); Peter Jax, Hannover (DE); Stefan Schandl, Vienna (AT); Herve Taddei, München (DE); Aulis Telle, Köln (DE); Peter Vary, Aachen (DE)

(73) Assignee: Siemens Aktiengesellschaft, Munich (DE)

( * ) Notice: Subject to any disclaimer, the term of this patent is extended or adjusted under 35 U.S.C. 154(b) by 925 days.

(21) Appl. No.: 11/662,592

(22) PCT Filed: Jun. 30, 2006

(86) PCT No.: PCT/EP2006/063742

§ 371 (c)(1),
(2), (4) Date: Mar. 13, 2007

(87) PCT Pub. No.: WO2007/073949

PCT Pub. Date: Jul. 5, 2007

(65) Prior Publication Data

US 2008/0126081 A1 May 29, 2008

(30) Foreign Application Priority Data

Jul. 13, 2005 (DE) ..... 10 2005 032 724

(51) Int. Cl.
*G10L 19/00* (2006.01)
*G10L 21/00* (2006.01)

(52) U.S. Cl. ..... 704/500; 704/201; 704/219

(58) Field of Classification Search ..... 704/201, 704/219, 500

See application file for complete search history.

(56) References Cited

U.S. PATENT DOCUMENTS

| | | | | |
|---|---|---|---|---|
| 6,895,375 | B2 * | 5/2005 | Malah et al. | 704/219 |
| 7,181,402 | B2 * | 2/2007 | Jax et al. | 704/500 |
| 7,191,123 | B1 * | 3/2007 | Bessette et al. | 704/225 |
| 2005/0004793 | A1 * | 1/2005 | Ojala et al. | 704/219 |

(Continued)

FOREIGN PATENT DOCUMENTS

DE 101 02 173 7/2002

(Continued)

OTHER PUBLICATIONS

Iser, B. "Bandwidth Extension of Telephony Speech." EURASIP News Letter ISSN 1687-1421, vol. 16 No. 2; Jun. 2005.*

(Continued)

*Primary Examiner* — Talivaldis Ivars Smits
*Assistant Examiner* — Shaun Roberts
(74) *Attorney, Agent, or Firm* — Staas & Halsey LLP

(57) ABSTRACT

A method for the artificial extension of the bandwidth of speech signals involves:

a) Provision of a wideband input speech signal ($s_{wb}^{i}(k)$);
b) Determination of the signal components ($s_{eb}(k)$) of the wideband input speech signal ($s_{wb}^{i}(k)$) required for the bandwidth extension from an extension band from the wideband input speech signal ($s_{wb}^{i}(k)$);
c) Determination of the temporal envelopes of the signal components ($s_{eb}(k)$) determined for the bandwidth extension;
d) Determination of the spectral envelopes of the signal components ($s_{eb}(k)$) determined for bandwidth extension;
e) Encoding of the information for the temporal envelopes and the spectral envelopes, and provision of the encoded information by carrying out the extension of the bandwidth;
f) Decoding of the encoded information and generation of the temporal envelopes and the spectral envelopes from the encoded information for the production of a bandwidth-extended output speech signal ($s_{wb}^{o}(k)$).

21 Claims, 2 Drawing Sheets

U.S. PATENT DOCUMENTS

2006/0277038 A1* 12/2006 Vos et al. ..... 704/219

FOREIGN PATENT DOCUMENTS

| | | |
|---|---|---|
| DE | 102 52 070 | 5/2004 |
| EP | 1 398 946 | 3/2004 |
| WO | 03/083834 | 10/2003 |

OTHER PUBLICATIONS

U.S. Appl. No. 60/667,901, filed Feb. 2005, Vos et al.*
Peter Jax et al., "An Upper Bound on the Quality of Artificial Bandwidth Extension of Narrowband Speech Signals", 2002 IEEE International Conference on Acoustics, Speech, and Signal Processing; Orlando, FL, May 13-17, 2002, vol. 4 of 4, pp. I-237 to I-240.
Peter Jax et al., "Wideband Extension of Telephone Speech Using A Hidden Markov Model", Speech Coding, 2000; Proceedings, 2000 IEEE Workshop on Sep. 17-20, 2000, Piscataway, NJ, pp. 133-135.
Jean-Marc Valin et al., "Bandwidth Extension of Narrowband Speech for Low Bit-Rate Wideband Coding", Speech Coding, 2000; Proceedings, 2000 IEEE Workshop on September 17-20, 2000, Piscataway, NJ, pp. 130-132.
Ulrich Kornagel, "Spectral Widening of the Excitation Signal for Telephone-Band Speech Enhancement", Proceedings of the Eusipco 2002, vol. II, Toulouse, France, Sep. 2002, pp. 339-342.
German Patent Office Search Report, mailed Jan. 31, 2008 and issued in German Patent Application No. 10 2005 032 724.9.
Jean-Marc Valin et al., *Bandwith Extension of Narrowband Speech for Low Bit-Rate Wideband Coding*, pp. 130-132, IEEE 2000.
Peter Jax et al., *An Upper Bound on the Quality of Artificial Bandwith Extension of Narrowband Speech Signals*, pp. 237-240, IEEE 2002.
Peter Jax et al., *Wideband Extension of Telephone Speech Using a Hidden Markov Model* pp. 133-135, IEEE 2000.

* cited by examiner

METHOD AND DEVICE FOR THE ARTIFICIAL EXTENSION OF THE BANDWIDTH OF SPEECH SIGNALS

CROSS REFERENCE TO RELATED APPLICATIONS

This application is based on and hereby claims priority to Application No. PCT/EP2006/063742 filed on Jun. 30, 2006 and DE Application No. 10 2005 032 724.9, filed on Jul. 13, 2005, the contents of which are hereby incorporated by reference.

BACKGROUND

The invention relates to a method as well as a device for the artificial extension of the bandwidth of speech signals.

Speech signals cover a wide frequency range that extends from the fundamental speech frequency, which depending on the speaker lies in the range between 80 to 160 Hz, up to the frequencies beyond 10 kHz. However, during speech communication via particular transmission media, such as telephones for example, only a limited segment is transmitted for reasons of bandwidth efficiency, whereby a sentence intelligibility of approximately 98% is ensured.

Corresponding to the minimum bandwidth from 300 Hz to 3.4 kHz specified for the telephone system, a speech signal can essentially be divided into three frequency ranges. In this way, each of these frequency ranges characterizes specific speech properties as well as subjective perceptions. Thus lower frequencies below approximately 300 Hz primarily arise during sonorous speech segments such as vowels, for example. In this case, this frequency range contains tonal components, which in particular means the fundamental speech frequency as well as several possible harmonics, depending on the pitch of the voice.

These low frequencies are important for the subjective perception of the volume and dynamics of a speech signal. In contrast, the fundamental speech frequency can be perceived by a human listener as a result of the psycho-acoustic property of virtual pitch perception from the harmonic structure in higher frequency ranges even if the low frequencies are missing. Thus medium frequencies in the range from approximately 300 Hz to approximately 3.4 kHz are basically present in the speech signal during speech activities. Their time-variant spectral coloration by multiple formants as well as the temporal and spectral fine structure characterizes the spoken sound or phoneme in each instance. In such a manner, the medium frequencies transport the main part of the information relevant for the intelligibility of the speech.

Alternatively, high frequency rates above approximately 3.4 kHz develop during unvoiced sounds, as is particularly strongly the case during sharp sounds such as "s" or "f", for example. In addition, so-called plosive sounds like "k" or "t" have a wide spectrum with strong high-frequency rates. Therefore, the signal has more of a noisy character than a tonal character in this upper frequency range. The structure of the formants that are also present in this range is relatively time-invariant, but varies for different speakers. The high frequency rates are of considerable importance for clarity, presence and naturalness of a speech signal, because without these high frequency rates the speech sounds dull. Furthermore, superior differentiation between fricatives and consonants is made possible by high frequency rates of this type, whereby these high frequency rates also thereby ensure increased intelligibility of the speech.

During a transmission of a speech signal via a speech communications system comprising a transmission channel with a limited bandwidth, in principle it is desired and is always the goal that the speech signal to be transmitted be capable of transmission with the best-possible quality from a transmitter to a receiver. Here the speech quality is however a subjective variable with a plurality of components, of which the intelligibility of the speech signal represents the most important for a speech communications systems of this type.

A relatively high level of speech intelligibility can already be achieved with modern digital transmission systems. At the same time, it is known that an improvement in the subjective assessment of the speech signal is made possible by an extension of the telephone bandwidth at high frequencies (higher than 3.4 kHz) as well as at low frequencies (lower than 300 Hz). In terms of a subjective quality improvement, a bandwidth increased in comparison to the normal telephone bandwidth is to be targeted for systems for speech communication. One possible approach relates to in modifying the transmission and in effecting a wider transmitted bandwidth by an encoding method, or alternatively in performing an artificial bandwidth extension. Through an extension of the bandwidth of this type, the frequency bandwidth on the receiver side is widened to the range from 50 Hz to 7 kHz. Suitable signal processing algorithms allow parameters to be determined for the wideband model from short segments of a narrowband speech signal using methods of pattern recognition, said parameters then being used to estimate the missing signal components for the speech. With the method, a wideband equivalent with frequency components in the range 50 Hz to 7 kHz is created from the narrowband speech signal, and an improvement in the subjectively perceived speech quality is effected.

In current speech signal and audio signal encoding algorithms, additional techniques of artificial bandwidth extension are used. For example, in the wideband range (acoustic bandwidth of 50 Hz to 7 kHz) speech encoding standards such as the AMR-WB (Adaptive Multirate Wideband) encoding-decoding algorithm are used. With this AMR-WB standard, upper frequency subbands (frequency range of approximately 6.4 to 7 kHz) are extrapolated from lower frequency components. In encoding-decoding methods of this type, the bandwidth extension is generally produced by a comparatively small amount of ancillary information. This ancillary information can be filter coefficients or amplification factors for instance, whereby the filter coefficients can be produced by an LPC (Linear Prediction Filter) method for example. This ancillary information is transmitted to a receiver in an encoded bitstream. Other standards which are based on the extension of the bandwidth technique can currently be seen in the standards AMR-WB+ and the extended aacPlus speech/audio encoding-decoding method. Methods that are designed to encode and decode information are called codecs and include both an encoder as well as a decoder. Every digital telephone, regardless of whether it is designed for a fixed network or a mobile radio network, contains a codec of the type that converts analogue signals into digital signals, and digital signals into analogue signals. A codec of this type can be implemented in hardware or in software.

In current implementations of speech/audio signal encoding algorithms in which the technology for bandwidth extension is used, components of an extension band, for example in the frequency range from 6.4 to 7 kHz, are encoded and decoded by the LPC encoding technology already mentioned. In doing so, an LPC analysis of the extension band of the input signal is carried out in an encoder, and the LPC coefficients as well as the amplification factors are encoded from subframes of a residual signal. The residual signal of the extension band is produced in a decoder, and the transmitted amplification factors and the LPC synthesis filters are used for the generation of an output signal. The approach described above can be used either directly on the wideband input signal or even with a subband signal from the extension band downsampled at a threshold or in a critical range.

In the extended aacPlus encoding standard, the SBR (Spectral Band Replication) technique is used. At the same time, the wideband audio signal is split into frequency subbands by a 64-channel QMF filter bank. For the high-frequency filter bank channels, a sophisticated and technically highly developed parametric encoding is applied to the subbands of the signal components, whereby a large number of detectors and estimators are necessary for this purpose, which are used in order to control the bitstream content. Even though an improvement, in particular in the speech quality of speech signals, can already be achieved using the known standards and encoding-decoding methods, an additional improvement in this speech quality is nevertheless to be targeted. Furthermore, the standards and encoding-decoding methods described above are very time-consuming and have a very complex structure.

SUMMARY

As such, the one possible object of the present invention is to provide a method and a device for the artificial extension of the bandwidth of speech signal, with which improved speech quality and improved speech intelligibility can be achieved. Furthermore, this should be able to be implemented in a relatively simple and inexpensive manner.

The following steps are carried out in a method proposed by the inventors, for the artificial extension of the bandwidth of speech signals:

a) Provision of a wideband input speech signal;
b) Determination of the signal components of the wideband input speech signal required for the bandwidth extension from an extension band of the wideband input speech signal;
c) Determination of the temporal envelopes of the signal components determined for the bandwidth extension;
d) Determination of the spectral envelopes of the signal components determined for the bandwidth extension;
e) Encoding of the information of the temporal envelopes and of the spectral envelopes, and provision of the encoded information for carrying out the extension of the bandwidth; and
f) Decoding of the encoded information and generation of the temporal envelopes and of the spectral envelopes from the encoded information for the production of a bandwidth-extended output speech signal.

The method allows an improvement in the speech intelligibility and the speech quality during the transmission of speech signals to be achieved, with audio signals also being considered as speech signals. Furthermore, the method is also very robust with respect to disruptions during transmission.

The signal components necessary for bandwidth extension are advantageously determined from the wideband input speech signal by filtering, in particular bandpass filtering, whereby a simple and inexpensive selection of the necessary signal components can be carried out.

The determination of the temporal envelopes in step c) is preferably carried out independently of the determination of the spectral envelopes in step d). The envelopes can thus be determined in a precise manner, whereby a mutual interaction can be avoided.

A quantization of the temporal envelopes and the spectral envelopes is preferably carried out prior to the encoding of the temporal envelopes and the spectral envelopes in step e). The signal powers are determined from spectral subbands of the signal components determined for the bandwidth extension in an advantageous manner in step d) for the determination of the spectral envelopes. In this way, the temporal and spectral envelopes for the characterization can be determined very precisely.

In order to determine the signal powers of the spectral subbands, signal segments of the signal components determined for the bandwidth extension are generated in a preferred manner, with these signal segments in particular being transformed, in particular FF (Fast Fourier) transformed. In addition, the signal powers are determined from temporal signal segments of the signal components determined for the bandwidth extension in an advantageous manner in step c) for the determination of the temporal envelopes. The necessary parameters can herewith be determined in an inexpensive manner.

The encoded information relating to the forms to be reconstructed of the temporal envelopes and of the spectral envelopes are decoded in step f) in an advantageous manner.

An excitation signal is advantageously produced in a decoder from a signal transmitted to a decoder, with the transmitted signal comprising a signal power of this type in the frequency range that corresponds to that of the extension signal of the wideband input speech signal, which enables the production of an excitation signal. A modulated narrowband signal with a bandwidth with frequencies below the frequencies of the bandwidth of the extension band of the wideband input speech signal is preferably transmitted to the decoder for the production of the excitation signal. The excitation signal preferably has harmonics of the fundamental frequency of the signal transmitted to the decoder.

A first correction factor is advantageously determined from the decoded information of the temporal envelopes and the excitation signal. Furthermore, a reconstructed formation of the temporal envelopes is carried out from the first correction factor and the excitation signal, in particular by multiplying the first correction factor with the excitation signal. Furthermore, the reconstructed formation of the temporal envelopes is advantageously filtered, and pulse responses are produced at the time of filtering. A reconstructed formation of the spectral envelopes is carried out from the pulse responses and the reconstructed formation of the temporal envelopes. In addition, the signal components of the extension band of the wideband input speech signal are reconstructed from the reconstructed formation of the spectral envelopes. The reconstruction of the temporal and the spectral envelopes can herewith be carried out very reliably and very accurately.

A narrowband signal with a bandwidth with frequencies below the frequencies of the extension band of the wideband input signal is transmitted to the decoder in an advantageous embodiment.

The bandwidth-extended output speech signal is determined in an advantageous manner from the narrowband signal transmitted to the decoder and the reconstructed formation of the spectral envelopes, in particular from a summation of these two signals, and is provided as an output signal of the decoder. Thus an output signal can be created and provided, which ensures a high level of speech intelligibility and speech quality.

The steps a) through e) are preferably carried out in an encoder, which is preferably arranged in a transmitter. The encoded information produced in step e) is transmitted in an advantageous manner to the decoder as a digital signal. At least step f) is carried out in a preferred manner in a receiver, with the decoder being arranged in the receiver. However, it can also be provided that all steps a) through f) of the method are carried out in a receiver. In this case, the steps a) through e) are replaced in the receiver by an estimation process (to be implemented differently). The steps a) through e) can also be carried out separately in a transmitter.

The wideband input speech signal advantageously includes a bandwidth between approximately 50 Hz and approximately 7 kHz. The extension band of the wideband input speech signal preferably includes the frequency range of between approximately 3.4 kHz and approximately 7 kHz. In addition, the narrowband signal includes a signal range of the wideband input speech signal of approximately 50 Hz to approximately 3.4 kHz.

A device for the artificial extension of the bandwidth of speech signals, in which a wideband input speech signal can be placed, comprises at least the following components:

a) A determination unit to determine the signal components of the wideband input speech signal required for the bandwidth extension from an extension band of the wideband input speech signal;
b) A determination unit to determine the temporal envelopes of the signal components determined for the bandwidth extension;
c) A determination unit to determine the spectral envelopes of the signal components determined for the bandwidth extension;
d) an encoder for the encoding of the temporal envelopes and the spectral envelopes, and provision of the encoded information for carrying out the extension of the bandwidth; and
e) a decoder for decoding the encoded information and generation of the temporal envelopes and the spectral envelopes from the encoded information for the production of a bandwidth-extended output speech signal.

The device enables improved speech quality and improved speech intelligibility of speech signals during transmission in communications devices, such as mobile radio devices or ISDN devices for example.

The units a) through d) is advantageously embodied as an encoder. The encoder can be arranged in a transmitter or in a receiver, with the decoder being arranged in a receiver.

Advantageous embodiments of the method can also be considered advantageous embodiments of the device, where transferable.

BRIEF DESCRIPTION OF THE DRAWINGS

These and other objects and advantages will become more apparent and more readily appreciated from the following description of the preferred embodiments, taken in conjunction with the accompanying drawings of which.

DETAILED DESCRIPTION OF THE PREFERRED EMBODIMENT

Figure 1:
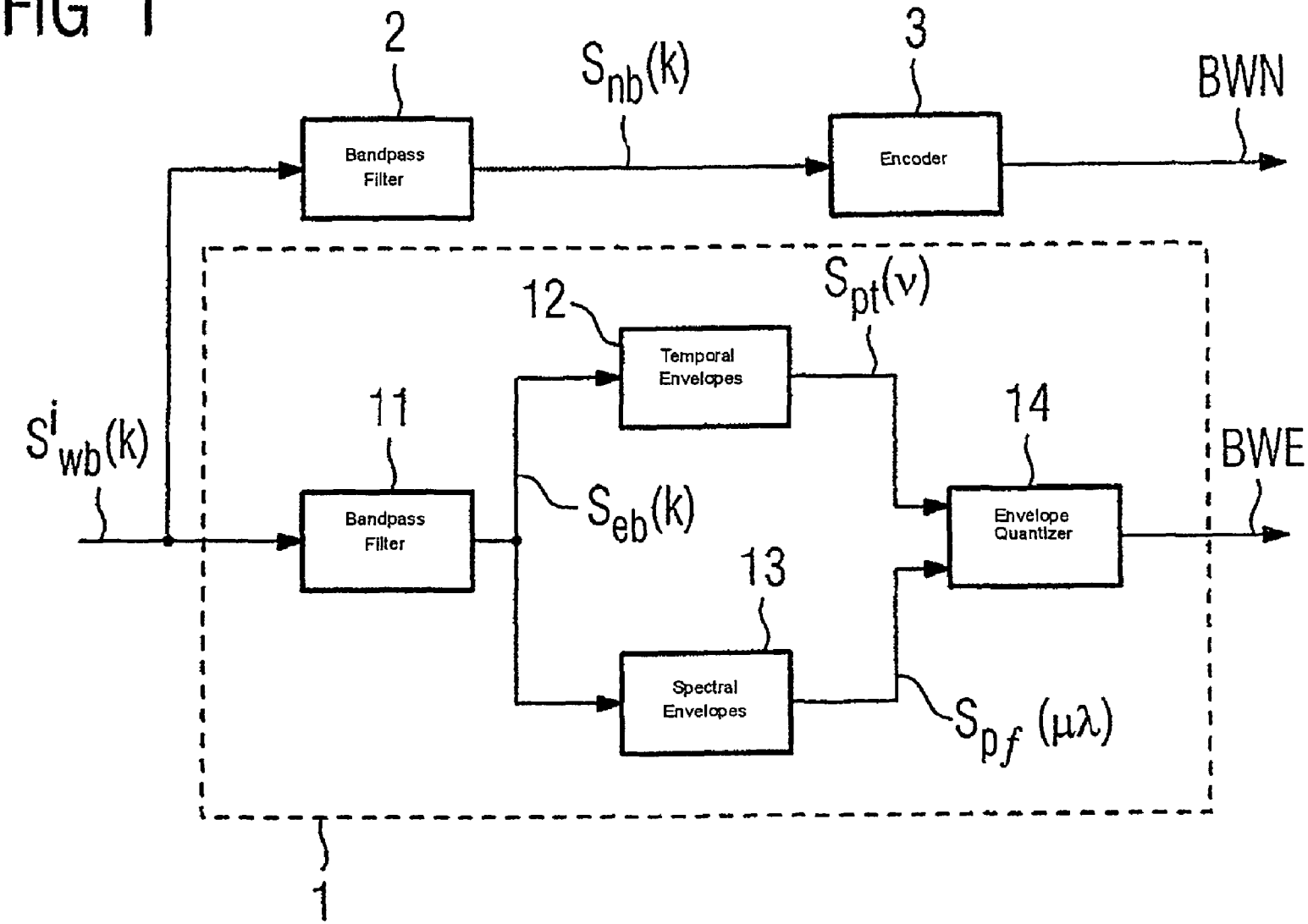
FIG. 1 shows an encoder of a device according to one embodiment of the invention.

Reference will now be made in detail to the preferred embodiments, examples of which are illustrated in the accompanying drawings, wherein like reference numerals refer to like elements throughout.

Figure 2:
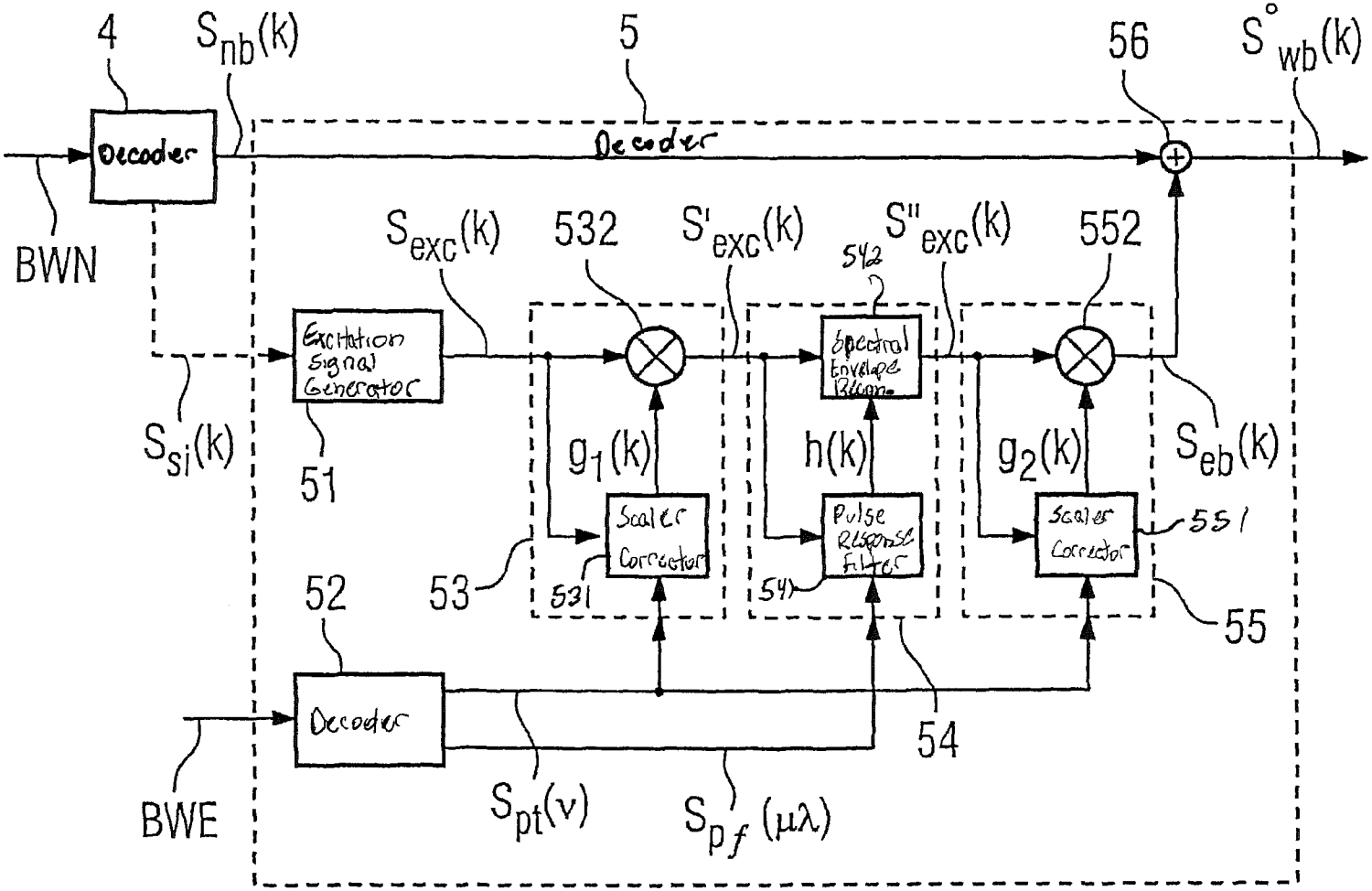
FIG. 2 shows a decoder of a device according to one embodiment of the invention.

The term 'speech signals' also includes audio signals as explained in greater detail below. In FIG. 1 and FIG. 2, identical or functionally identical elements are provided with the same reference figures.

FIG. 1 shows a schematic block diagram illustration of an encoder 1 of a device for the artificial extension of the bandwidth of speech signals. The encoder 1 can be implemented both in hardware as well as in software as an algorithm. In the exemplary embodiment, the encoder 1 includes a block 11, which is designed for bandpass filtering a wideband input speech signal $s_{wb}^{i}(k)$. In addition, the encoder 1 includes a block 12 and a block 13, which are associated with block 11. At the same time, block 12 is designed to determine the temporal envelopes of the signal components determined for the bandwidth extension, the latter being determined from an extension band of the wideband input speech signal. In a corresponding manner, block 13 is designed to determine the spectral envelopes of the signal components determined for the bandwidth extension, said signal components being determined from the extension band of the wideband input speech signal.

Furthermore, it is also to be recognized from the illustration in FIG. 1 that block 12 and block 13 are associated with a block 14, with block 14 being designed to quantize the temporal envelopes as well as the spectral envelopes that are generated by blocks 12 and 13.

In addition, a block 2 is shown in FIG. 1, which is designed as a bandpass filter, and in which the wideband input speech signal $s_{wb}^{i}(k)$ is located. In addition, block 2 is associated with an additional block 3, whereby block 3 is designed as an additional encoder.

In the exemplary embodiment, the encoder 1 as well as blocks 2 and 3 are arranged in a first telephone device. The wideband input speech signal has a bandwidth of approximately 50 Hz to approximately 7 kHz in the exemplary embodiment. This wideband input speech signal $s_{wb}^{i}(k)$ is located in the bandpass filter or block 11 of the encoder 1, as can be inferred from the illustration in FIG. 1. By this block 11, the signal components necessary for the bandwidth extension are determined from the extension band, which comprises a bandwidth of approximately 3.4 kHz to approximately 7 kHz in the exemplary embodiment. The signal components necessary for the bandwidth extension are characterized by the signal $s_{eb}(k)$ and are transmitted as an output signal from block 11 to both blocks 12 and 13. At the same time, the temporal envelopes are determined from this signal $s_{eb}(k)$. Accordingly, the spectral envelopes of the signal components that are characterized by the signal $s_{eb}(k)$ are determined in block 13.

This determination of the temporal envelopes as well as the spectral envelopes is explained in greater detail below. In this way, the signal $s_{eb}(k)$ characterizing the signal components necessary for the bandwidth extension is first segmented, and this windowed signal segment is transformed. The segmentation of the signals $s_{eb}(k)$ takes place in frames with a length of k sample values in each case. All subsequent steps and partial algorithms are carried out by frame consistently. Each speech frame (of 10 ms or 20 ms or 30 ms duration, for example) can be divided into multiple subframes (2.5 or 5 ms duration, for example) in an advantageous manner.

The windowed signal segments are then transformed. In the exemplary embodiment, a transformation is carried out here by a FFT (Fast Fourier Transform) in the frequency domain. The FFT transformed signal segments are determined here according to the following formula 1):

$$S_{wf}(i) = \sum_{\kappa=0}^{N_f-1} s_{eb}(\mu \cdot M_f + \kappa) \cdot w_f(\kappa) \cdot e^{-j i \kappa \frac{2\pi}{N_f}}$$

In this formula 1), $N_f$ designates the FFT length or the frame size, $\mu$ designates the frame index and $M_f$ designates the overlapping of the frames of the windowed signal segments. In addition, $w_f(\kappa)$ identifies the window function. The signal power in subbands of the frequency range of the extension band is then subsequently calculated in the frequency domain. This calculation of the signal strength or of the signal power is performed according to the following formula 2):

$$P_f(\mu, \lambda) = \sum_{i \in EB_\lambda} w_\lambda(i) \cdot |S_{wf}(i)|^2$$

In this formula 2), $\lambda$ designates the index of the corresponding subband, whereby $EB_\lambda$ characterizes the amount that contains all FFT interval ranges i with non-null coefficients in the $\lambda$ frequency domain window $w_\lambda(i)$. The signal powers $P_f(\mu,\lambda)$ for the subbands according to formula 2) characterize the information of the spectral envelopes, which are transmitted to a decoder.

The determination of the temporal envelopes in the time domain is carried out in a manner similar to that for the determination of the spectral envelopes, and is based on short-term windowed segments of the bandpass-filtered wideband input speech signal $s_{wb}^i(k)$. Signal segments of the signal $s_{eb}(k)$ are therefore taken into consideration during the determination of the temporal envelopes as well. The signal power is calculated for each windowed segment according to the following formula 3:

$$P_t(\nu) = \sum_{\kappa=0}^{N_t-1} (s_{eb}(\nu \cdot M_t + \kappa) \cdot w_t(\kappa))^2$$

In this formula 3), $N_t$ designates the frame length, v designates the frame index and $M_t$ in turn designates the overlapping of the frames of the signal segments. It should be noted that, in general, the frame length $N_t$ and the overlapping of the frames $M_t$, which are used for the extraction of the temporal envelopes, are smaller or much smaller than the corresponding figures $N_f$ and $M_f$, which are used for the determination of the spectral envelopes.

An alternative for the extraction of the parameters of the temporal envelopes of the signal $s_{eb}(k)$ can be seen in that a Hilbert transformation (90° phase shift filter) of the signal $s_{eb}(k)$ is carried out. A summation of the short-segment signal powers of the filtered parts and of the original parts of the signal $s_{eb}(k)$ results in the short-term temporal envelopes which are downsampled in order to determine the signal powers $P_t(v)$. The signal powers $P_t(v)$ of the signal segments then characterize the information for the temporal envelopes.

The signals $s_{P_t(\nu)}$ and $s_{P_f(\mu,\lambda)}$ characterizing the temporal envelopes and spectral envelopes, said signals characterizing the extracted parameters of the signal powers according to formulas 2) and 3), are quantized and encoded in block 14. The output signal of block 14 is a digital signal BWE, which characterizes a bitstream that contains information for the temporal envelopes and the spectral envelopes in encoded form.

This digital signal BWE is transmitted to a decoder which is to be explained in greater detail below. It should be noted that a collective or associated encoding, as can be made possible by a vector quantization, for example, can be carried out in the case of a redundancy between the extracted parameters of the signal strengths according to formulas 2) and 3).

Furthermore, as can be seen from the illustration in FIG. 1, the wideband input speech signal $s_{wb}^i(k)$ is also transmitted to block 2.

The signal components of a narrowband range of the wideband input speech signal $s_{wb}^i(k)$ are filtered by this block 2, which is embodied as a bandpass filter. The narrowband range lies between 50 Hz and 3.4 kHz in the exemplary embodiment. The output signal of block 2 is a narrowband signal $s_{nb}(k)$ and is transmitted to block 3, which is embodied as an additional encoder in the exemplary embodiment. In this block 3, the narrowband signal $s_{nb}(k)$ is encoded and transmitted as a bitstream to the decoder described below as a digital signal BWN.

In FIG. 2, a schematic block diagram illustration of a decoder 5 of this type of a device for the artificial extension of the bandwidth of speech signals is shown. As can be seen from FIG. 2, the digital signal BWN is then first transmitted to an additional decoder 4, which decodes the information contained in the digital signal BWN, and which in turn produces the narrowband signal $s_{nb}(k)$ therefrom. In addition, the decoder 4 generates an additional signal $s_{si}(k)$ that contains ancillary information. This ancillary information can be amplification factors or filter coefficients, for example. This signal $s_{si}(k)$ is transmitted to a block 51 of the decoder 5. In the exemplary embodiment, block 51 is designed for the generation of an excitation signal in the frequency range of the extension band, whereby the information of the signal $s_{si}(k)$ is taken into consideration for this purpose.

Furthermore, the decoder 5, which is arranged in a receiver in the exemplary embodiment, has a block 52, which is designed for the decoding of the signal BWE transmitted between the encoder 1 and the decoder 2 via a transmission route. It is should be noted that even the digital signal BWN is transmitted via this transmission route between the encoder 1 and the decoder 5. As can be seen from the illustration in FIG. 2, both block 51 and block 52 are associated with decoder ranges 53 through 55. The functional principle of the decoder 5 and the partial steps of the method carried out in the decoder 5 are explained in greater detail below.

As already addressed above, the information contained in the encoded digital signal BWE is decoded in block 52, and the signal powers that are calculated according to formulas 2) and 3), and which characterize the temporal envelopes and the spectral envelopes, are reconstructed. As can be seen from the illustration in FIG. 2, the excitation signal $s_{exc}(k)$ produced in block 51 is the input signal for the reconstructed formation of the temporal envelopes and the spectral envelopes. At the same time, this excitation signal $s_{exc}(k)$ can essentially be an arbitrary signal, whereby an important requirement for this signal must be that it has sufficient signal power in the frequency range of the extension band of the wideband input spectral signal $s_{wb}^i(k)$. For example, a modulated version of the narrowband signal $s_{nb}(k)$ or any arbitrary sound can be used as an excitation signal $s_{exc}(k)$. As already explained, this excitation signal $s_{exc}(k)$ is responsible for the fine structuring of the spectral envelopes and the temporal envelopes in the signal components of the extension band of a wideband output speech signal $s_{wb}^o(k)$. For this reason, it is advantageous that this excitation signal $s_{exc}(k)$ is produced in such a manner that it has the harmonics of the fundamental frequency of the narrowband signal $s_{nb}(k)$.

In the case of hierarchical speech encoding, there is an option of achieving this by using parameter of the additional decoder 4. For example, if $\Delta_k$ is a proportional or actual shift of the fundamental frequency and b of the LTB amplification factor for an adaptive code book in a CELP narrowband decoder, then an excitation with harmonic frequencies is possible, for example, during an integral multiplication of the momentary fundamental frequency through an LTP synthesis filtration by a bandpass filter (frequency range of the extension band) from an arbitrary signal $n_{eb}(k)$.

At the same time, the FFT excitation signal emerges according to the following formula 4):

$$s_{exc}(k)=n_{eb}(k)+f(b)\cdot s_{exc}(k-\Delta_k)$$

At the same time, the LTP amplification factor can be reduced or limited by the function f(b), in order to be able to prevent an overvoicing of the produced signal components of the extension band. It should be noted that a plurality of additional alternatives can be carried out in order to be able to carry out a synthetic wideband excitation by parameters of a narrowband codec.

An additional option for being able to produce an excitation signal relates to modulation of the narrowband signal $s_{nb}(k)$ being carried out with a sine function at a fixed frequency, or through a direct use of an arbitrary signal $n_{eb}(k)$, as was already defined above. It should be emphasized that the method that is used for the production of the excitation signal $s_{exc}(k)$ is completely independent of the generation of the digital signal BWE as well as the format of this digital signal BWE as well as the decoding of this digital signal BWE. As such, an independent adjustment can be carried out in this regard.

The reconstructed formation of the temporal envelopes is explained in greater detail below. As already addressed, the digital signal BWE is decoded in block 52, and the parameters characterizing the temporal envelopes and the spectral envelopes for the signal powers that are calculated according to formulas 2) and 3) are provided corresponding to the signals $s_{p_t(v)}$ and $s_{p_f(\mu,\lambda)}$. As can be inferred from the illustration in FIG. 2, a reconstructed formation of the temporal envelopes is then carried out in the exemplary embodiment. This is carried out in the decoder area 53. To this end, the excitation signal $s_{exc}(k)$ as well as the signal $s_{p_t(v)}$ is transmitted to this decoder area 53. As shown in FIG. 2, the excitation signal $s_{exc}(k)$ is transmitted to both a block 531 and a multiplier 532. This signal $s_{p_t(v)}$ is also transmitted to block 531. A scalar correction factor $g_1(k)$ is produced from these signals transmitted to block 531. This scalar correction factor $g_1(k)$ is transmitted from block 531 to the multiplier 532. The excitation signal $s_{exc}(k)$ is then multiplied in the multiplier 532 with this scalar correction factor $g_1$, and an output signal $s'_{exc}(k)$ is produced, said output signal characterizing the reconstructed formation of the temporal envelopes. This output signal $s'_{exc}(k)$ has the approximately correct temporal envelopes, but is still inaccurate or imprecise with regard to the correct frequency, whereby the implementation of a reconstructed formation of the spectral envelopes is required in the subsequent step in order to be able to adjust this imprecise frequency to the required frequency.

As can be seen here from FIG. 2, the output signal $s'_{exc}(k)$ is transmitted to a second decoder area 54 of the decoder 5, to which the signal $s_{p_f(\mu,\lambda)}$ is also transmitted. The second decoder area 54 has a block 541 and a block 542, whereby block 541 is designed for the filtration of the output signal $s'_{exc}(k)$. A pulse response h(k) is produced from the output signal $s'_{exc}(k)$ and the signal $s_{p_f(\mu,\lambda)}$, said pulse response being transmitted from block 541 to block 542. The reconstructed formation of the spectral envelopes is then carried out in this block 542 from the output signal $s'_{exc}(k)$ and the pulse response h(k). This reconstructed spectral envelope is then characterized by the output signal $s''_{exc}(k)$ of block 542.

In the exemplary embodiment shown according to FIG. 2, after the production of the output signal $s''_{exc}(k)$ of the second decoder area 54, a reconstructed formation of the temporal envelopes is carried out again in a third decoder area 55 of the decoder 5. This reconstructed formation of the temporal envelopes is carried out in a manner analogous to that carried out in the first decoder area 53. At the same time, in this third decoder area 55 a second scalar correction factor $g_2(k)$ is generated through block 551 from the output signal $s''_{exc}(k)$ and the signal $s_{p_t}(v)$. The correction factor $g_2(k)$ is transmitted to a multiplier 552. The signal $s_{eb}(k)$ characterizing the signal components necessary for the bandwidth extension is then provided as an output signal of the third decoder area 55 of the decoder 5. This signal $s_{eb}(k)$ is transmitted to a summing unit 56, to which the narrowband signal $s_{nb}(k)$ is also transmitted. Through the summation of the narrowband signal $s_{nb}(k)$ and the signal $s_{eb}(k)$, the bandwidth-extended output signal $s_{wb}^{o}(k)$ is produced and provided as an output signal of the decoder 5.

It should be noted that the embodiment shown in FIG is merely exemplary, and that even a single reconstructed formation of the temporal envelopes, as is carried out in the first decoder area 53, and a single reconstructed formation of the spectral envelopes, as is carried out in the second decoder area 54, is sufficient. It should likewise be noted that it can also be provided that the reconstructed formation of the spectral envelopes in the second decoder area 54 is carried out prior to the reconstructed formation of the temporal envelopes in the first decoder area 53. This means that in an embodiment of this type the second decoder area 54 is arranged upstream of the first decoder area 53. However, it can also be provided that the alternating performance of a reconstructed formation of the temporal envelopes and a reconstructed formation of the spectral envelopes is continued once more, and that an additional decoder area is subsequently arranged in the third decoder area 55 in the embodiment shown in FIG. 2, for example, in which decoder area 55 a reconstructed formation is carried out in turn for the spectral envelopes.

As already stated above, the proposed method and device are used in the exemplary embodiment in an advantageous manner for a wideband input speech signal with a frequency range of approximately 50 Hz to 7 kHz. Likewise, in the exemplary embodiment, the proposed method and device are provided for the artificial extension of the bandwidth of speech signals, whereby the extension band is determined by the frequency range of approximately 3.4 kHz to approximately 7 kHz when doing so. However, it can also be provided that the proposed method and device are used for an extension band that is located in a lower frequency range. In this way, the extension band can include a frequency range of approximately 50 Hz or even lower frequencies, up to a frequency range of approximately 3.4 kHz for example. It should be explicitly emphasized that the method for the artificial extension of the bandwidth of speech signals may also be used in such a manner that the extension band includes a frequency range that is above a frequency of approximately 7 kHz, at least in part, and up to 8 kHz for example, 10 kHz in particular, or even higher.

As already explained, a reconstructed formation for the temporal envelopes is generated in the first decoder area 53 according to FIG. 2 by multiplying the scalar first correction factor $g_1(k)$ and the excitation signal $s_{exc}(k)$. At the same time, it should be noted that a multiplication in the time domain corresponds to a convolution in the frequency domain, whereby the following formula 5) results:

$$s'_{exc}(k)=g(k)\cdot s_{exc}(k);$$

$$S'_{exc}(z)=G(z)*S_{exc}(z)$$

As long as the spectral envelopes are not changed in principle by the first decoder area 53, the first scalar correction factor or amplification factor $g_1(k)$ has strict low-pass frequency characteristics.

For the calculation of these amplification factors or these first correction factors $g_1(k)$, the excitation signal $s_{exc}(k)$ is segmented and analyzed in the manner already carried out above for the segmentation and the analysis of the extraction of the temporal envelopes or the production of the signal $s_{p_t(v)}$ from the signal $s_{eb}(k)$ in the encoder 1 by block 12. The relationship between the decoded signal power, as is calculated by formula 3), and the analyzed result of the signal strengths $P_t^{exc}(v)$ result in a desired amplification factor $\gamma(v)$ for the v-te signal segment. This amplification factor of the v-te signal segment is calculated according to the following formula 6):

$$\gamma(v)=\sqrt{\frac{P_t(v)}{P_t^{exc}(v)}}$$

The amplification factor or first correction factor $g_1(k)$ is calculated from this amplification factor $\gamma(v)$ by interpolation and low-pass filtration. In this process, the low-pass filtration is of decisive importance for restricting the effect of this amplification factor or this first correction factor $g_1(k)$ to the spectral envelopes.

The reconstructed formation of the spectral envelopes of the necessary signal components of the extension band is determined by filtering the output signal $s'_{exc}(k)$, which characterizes the reconstructed formation of the temporal envelopes. At the same time, the filter operation can be implemented in the time domain or in the frequency domain. In order to be able to avoid a large time variation or time drift for the pulse response h(k), the corresponding frequency characteristic H(z) can be smoothed. In order to be able to determine the desired frequency characteristics, the output signal $s'_{exc}(k)$ of the first decoder area 53 is analyzed in order to be able to find the signal powers for $P_f^{exc}(\mu, \lambda)$. The desired amplification factor $\Phi(\mu, \lambda)$ of a corresponding subband of the frequency range of the extension band is calculated according to the following formula 7):

$$\Phi(\mu,\lambda)=\sqrt{\frac{P_f(\mu,\lambda)}{P_f^{exc}(\mu,\lambda)}}$$

The frequency characteristic $H(\mu,i)$ of the form filter of the spectral envelopes can be calculated through an interpolation of the amplification factor $\Phi(\mu,\lambda)$ and with a smoothing, taking the frequency into account. If the formation filter of the spectral envelopes are to be used in the time domain, for example through a linear-phase FIR filter, the filter coefficients can be calculated through an inverse FF transformation of the frequency characteristic $H(\lambda,i)$ and a subsequent windowing.

As was explained and demonstrated in the examples above, the reconstructed formation of the temporal envelopes affects the reconstructed formation of the spectral envelopes and vice versa. It is therefore advantageous that, as explained in the exemplary embodiment and shown in FIG. 2, an alternating implementation of a reconstructed formation of a temporal envelope and a spectral envelope is carried out in an iterative process. By doing so, a substantially improved conformity of the temporal and spectral envelopes can be achieved for the signal components of the extension band, which are reconstructed in the decoder, and the temporal and spectral envelopes correspondingly produced in the encoder.

In the described exemplary embodiment according to FIG. 2, an iteration of one and one half times (reconstruction of the temporal envelopes, reconstruction of the spectral envelopes and repeated reconstruction of the temporal envelopes) is carried out. A bandwidth extension, as is made possible through the proposed method and device, simplifies the generation of an excitation signal with harmonics at the correct frequency for example during an integral multiplication of the fundamental frequency of the momentary sound. It is to be noted that the proposed method and device may also be used for downsampled subband signal components of the wideband input signal. This is then advantageous if a lesser computational effort is required.

The encoder 1 as well as blocks 2 and 3 are advantageously arranged in a transmitter, whereby logically even the processes carried out in blocks 2 and 3 as well as the encoder 1 are then also carried out in the transmitter. Block 4 as well as decoder 5 can be advantageously arranged in this receiver, whereby it also clear that the previous steps carried out in decoder 5 and in block 4 are processed in the receiver. It should be noted that the proposed method and device can also be implemented in such a manner that the processes carried out in encoder 1 are carried out in decoder 5 and are thus exclusively carried out in the receiver. At the same time, it can be provided that the signal powers that are calculated according to formulas 2) and 3) are estimated in the decoder 5. At the same time, block 52 in particular is designed for the estimation of this parameter of the signal powers. This embodiment makes it possible to conceal potential transmission errors of the ancillary information transmitted in the digital signal BWE. Through a temporary estimation of lost parameters of an envelope, for example through data loss, an undesirable conversion of the signal bandwidth can be prevented.

Differing from the known methods for the artificial extension of the bandwidth of speech signals, with the proposed method no transmissions of already-used amplification factors and filter coefficients as ancillary information take place, but rather only the desired temporal and spectral envelopes are transmitted to a decoder as ancillary information. Amplification factors and filter coefficients are then first calculated in the decoder that is arranged in a receiver. The artificial extension of the bandwidth can be analyzed in this way in the receiver, and can be corrected, if necessary, in an inexpensive manner. Furthermore, the proposed method as well as the proposed device are very robust with respect to disruptions to the excitation signal, with a disruption of this type of a received narrowband signal being able to be generated by transmission errors.

Very good resolution or division can be achieved in the time domain and in the frequency domain by separately implementing the analysis, the transmission and the reconstructed shape of the temporal and spectral envelopes. Splitting in the time domain and the frequency domain may be achieved. This leads to very good reproducibility both of steady sounds and signals as well as of temporary or brief signals. For speech signals, the reproduction of stop consonants and plosives benefits from the significantly improved time resolution.

In contrast to known bandwidth extensions, the proposed method enables the frequency formation to be carried out by linear phase FIR filters instead of LPC synthesis filters. Typical artefacts ("filter ringing") can also be reduced by doing so. Furthermore, the proposed method enables a very flexible and modular design, which furthermore makes it possible for the individual blocks in the receiver or in the decoder 5 to be exchanged or discontinued in a simple way. In an advantageous manner, no modification of the transmitter or the encoder 1 or of the format of the transmissions signal with which the encoded information is transmitted to the decoder 5 or the receiver is necessary for such a modification or discontinuation. Furthermore, different decoders may be operated with the proposed method, whereby a reproduction of the wideband input signal can be carried out with variable precision depending on the available computing power.

It should also be noted that the received parameters which characterize the spectral and temporal envelopes can be used not only for an extension of the bandwidth, but also for the support of subsequent signal processing blocks, such as a subsequent filtration, for example, or additional encoding steps such as transformation encoders can be used.

The resulting narrowband speech signal $s_{nb}(k)$, as is available to the algorithm for bandwidth extension, can exist after a reduction of the scanning frequency by a factor of 2 with a scanning rate of 8 kHz, for example.

With the proposed method and the underlying principle of bandwidth extension, it is possible to generate a wideband excitation of information for the G.729A+ standards. The data rates for the ancillary information transmitted in the digital signal BWE can amount to approximately 2 kbit/s. Furthermore, the proposed method requires a calculation system of relatively low complexity or a computational effort of relatively low complexity, which amounts to less than 3 WMOPS. Furthermore, the proposed method and the proposed device are very robust with respect to base-band disruptions of the G.729A+ standards. The principles can also be used in an advantageous manner for deployment in voice over IP. Furthermore, the method and the device are compatible with TDAC envelopes. Last but not least, the proposed method and device have a very modular and flexible design, and a modular and flexible concept.

A description has been provided with particular reference to preferred embodiments thereof and examples, but it will be understood that variations and modifications can be effected within the spirit and scope of the claims which may include the phrase "at least one of A, B and C" as an alternative expression that means one or more of A, B and C may be used, contrary to the holding in *Superguide* v. *DIRECTV,* 358 F3d 870, 69 USPQ2d 1865 (Fed. Cir. 2004).

The invention claimed is:

1. A method for artificial extension of bandwidth of speech signals, comprising:

encoding by a process comprising:

providing a wideband input speech signal, the wideband input speech signal having an extension band outside of non-extended band;

determining signal components within the extension band of the wideband input speech signal, the signal components being required for bandwidth extension into the extension band of the wideband input speech signal;

determining spectral envelopes of the signal components;

determining temporal envelopes of the signal components, the temporal envelopes being determined independently of the spectral envelopes, without using the spectral envelopes as an input; and encoding information for the temporal envelopes and the spectral envelopes to produce encoded information for extending the bandwidth; and decoding the encoded information and reconstructing the temporal envelopes and the spectral envelopes from the encoded information to thereby produce an output speech signal with extended bandwidth, wherein decoding and reconstructing comprise:

producing an excitation signal in a decoder from an input signal transmitted to the decoder;

determining a first correction factor from decoded information of the temporal envelopes and from the excitation signal;

in a first reconstruction, forming reconstructed temporal envelopes by multiplying the first correction factor with the excitation signal;

filtering the reconstructed temporal envelopes to produce pulse responses while filtering; and in a second reconstruction, forming reconstructed spectral envelopes from the pulse responses and the reconstructed temporal envelopes.

2. The method as claimed in claim 1, wherein the signal components are determined by bandpass filtering the wideband input speech signal.

3. The method as claimed in claim 1, wherein a quantization of the temporal envelopes and the spectral envelopes is carried out prior to the encoding information for the temporal envelopes and the spectral envelopes.

4. The method as claimed in claim 1, wherein determining the spectral envelopes is performed by determining signal powers from spectral subbands of the signal components.

5. The method as claimed in claim 4, wherein signal segments of the signal components are produced for determining the signal powers of the spectral subbands, and a Fast Fourier transform is performed on the signal segments.

6. The method as claimed in claim 1, wherein determining the temporal envelopes involves determining signal strengths from temporal signal segments of the signal components.

7. The method as claimed in claim 5, wherein determining the temporal envelopes involves determining signal strengths from temporal signal segments of the signal components.

8. The method as claimed in claim 1, wherein a modulated narrowband signal with a bandwidth frequency range below a bandwidth frequency range of the extension band of the wideband input speech signal is transmitted to the decoder for the production of excitation signal.

9. The method as claimed in claim 1, wherein the excitation signal has harmonics of a fundamental frequency of the input signal transmitted to the decoder.

10. The method as claimed in claim 1, wherein the signal components within the extension band of the wideband input speech signal are reconstructed from the reconstructed spectral envelopes.

11. The method as claimed in claim 10, wherein a narrowband signal with a bandwidth frequency range below a bandwidth frequency range of the extension band of the wideband input signal is transmitted to a decoder, the output speech signal is determined by summing the narrowband signal transmitted to the decoder and the reconstructed spectral envelopes, and the output speech signal is output from the decoder.

12. The method as claimed in claim 1, wherein a narrowband signal with a bandwidth frequency range below a bandwidth frequency range of the extension band of the wideband input signal is transmitted to a decoder.

13. The method as claimed in claim 12, wherein the bandwidth frequency range of the narrowband signal is within that of the wideband input speech signal, and the bandwidth frequency range of the narrowband signal is from approximately 50 Hz to approximately 3.4 kHz.

14. The method as claimed in claim 1, wherein determining signal components within the extension band, determining temporal envelopes, determining spectral envelopes and encoding information are carried out in an encoder, and the encoded information is transmitted as a digital signal for decoding purposes.

15. The method as claimed in claim 1, wherein the wideband input speech signal has a frequency range between approximately 50 Hz and approximately 7 kHz.

16. The method as claimed in claim 1, wherein the extension band of the wideband input speech signal has a frequency range of approximately 3.4 kHz to approximately 7 kHz.

17. The method as claimed in claim 1, wherein decoding and reconstructing further comprise:

determining a second correction factor from decoded information of the temporal envelopes and from the reconstructed spectral envelopes; and in a third reconstruction, temporally shaping the reconstructed spectral envelopes by multiplying the second correction factor with the reconstructed spectral envelopes.

18. A device for artificial extension of bandwidth of speech signals comprising:

an encoder device comprising:

a first determination unit to determine signal components within an extension band of a wideband input speech signal;

a second determination unit to determine spectral envelopes for the signal components;

a third determination unit to determine temporal envelopes for the signal components, the temporal envelopes being determined independently of the spectral envelopes, without using the spectral envelopes as an input; and an encoder to encode the temporal envelopes and the spectral envelopes, and produce encoded information; and a decoder to decode the encoded information and regenerate the temporal envelopes and the spectral envelopes and produce a bandwidth-extended output speech signal, wherein the decoder comprises:

an excitation signal generator to generate an excitation signal from an input signal transmitted to the decoder;

a first correction unit to determine a first correction factor from decoded information of the temporal envelopes and from the excitation signal, and to form reconstructed temporal envelopes by multiplying the first correction factor with the excitation signal; and a second correction unit to filter the reconstructed temporal envelopes to produce pulse responses while filtering, and to form reconstructed spectral envelopes from the pulse responses and the reconstructed temporal envelopes.

19. The device as claimed in claim 18, further comprising:

a third reconstruction unit to determine a second correction factor from decoded information of the temporal envelopes and from the reconstructed spectral envelopes, and to temporally shaping the reconstructed spectral envelopes by multiplying the second correction factor with the reconstructed spectral envelopes.

20. A method for artificial extension of bandwidth of speech signals, comprising:

providing a wideband input speech signal, the wideband input speech signal having an extension band outside of non-extended band;

determining signal components within the extension band of the wideband input speech signal, the signal components being required for bandwidth extension into the extension band of the wideband input speech signal;

determining temporal envelopes of the signal components;

determining spectral envelopes of the signal components independently of the temporal envelopes;

encoding information for the temporal envelopes and the spectral envelopes to produce encoded information for extending the bandwidth; and decoding the encoded information and reconstructing the temporal envelopes and the spectral envelopes from the encoded information to thereby produce an output speech signal with extended bandwidth, the decoding and reconstructing comprising:

producing an excitation signal in a decoder from an input signal transmitted to the decoder;

determining a first correction factor from decoded information of the temporal envelopes and from the excitation signal;

in a first reconstruction, forming reconstructed temporal envelopes by multiplying the first correction factor with the excitation signal; filtering the reconstructed temporal envelopes to produce pulse responses while filtering; and in a second reconstruction, forming reconstructed spectral envelopes from the pulse responses and the reconstructed temporal envelopes.

21. The method as claimed in claim 20, wherein decoding and reconstructing further comprise:

determining a second correction factor from decoded information of the temporal envelopes and from the reconstructed spectral envelopes; and in a third reconstruction, temporally shaping the reconstructed spectral envelopes by multiplying the second correction factor with the reconstructed spectral envelopes.

* * * * *